US010426693B2

(12) United States Patent
Ishikawa et al.

(10) Patent No.: US 10,426,693 B2
(45) Date of Patent: Oct. 1, 2019

(54) MASSAGE MACHINE

(71) Applicant: DAITO ELECTRIC MACHINE INDUSTRY COMPANY LIMITED, Higashi-Osaka-shi, Osaka (JP)

(72) Inventors: Tetsuya Ishikawa, Higashi-Osaka (JP); Shinsaku Shimizu, Higashi-Osaka (JP)

(73) Assignee: DAITO ELECTRIC MACHINE INDUSTRY COMPANY LIMITED, Higashi-Osaka-Shi, Osaka (JP)

( * ) Notice: Subject to any disclaimer, the term of this patent is extended or adjusted under 35 U.S.C. 154(b) by 508 days.

(21) Appl. No.: 15/121,679

(22) PCT Filed: Apr. 15, 2016

(86) PCT No.: PCT/JP2016/062054
§ 371 (c)(1),
(2) Date: Aug. 25, 2016

(87) PCT Pub. No.: WO2017/149786
PCT Pub. Date: Sep. 8, 2017

(65) Prior Publication Data

US 2018/0133095 A1 May 17, 2018

(30) Foreign Application Priority Data

Mar. 2, 2016 (JP) ..... 2016-40215

(51) Int. Cl.
*A61H 7/00* (2006.01)
*A61H 15/00* (2006.01)

(52) U.S. Cl.
CPC ..... *A61H 7/007* (2013.01); *A61H 2015/0014* (2013.01); *A61H 2201/0192* (2013.01);
(Continued)

(58) Field of Classification Search
CPC .... A61H 2201/0138; A61H 2201/0157; A61H 2201/164; A61H 2201/1678;
(Continued)

(56) References Cited

U.S. PATENT DOCUMENTS 5,445,595 A * 8/1995 Chou ..... A61H 7/004 601/102
7,108,670 B2 * 9/2006 Huang ..... A61H 7/004 601/134
(Continued)

FOREIGN PATENT DOCUMENTS

CN 1509696 A 7/2004
CN 1778284 A 5/2006
(Continued)

*Primary Examiner* — Scott J Medway
*Assistant Examiner* — Alexander Morales
(74) *Attorney, Agent, or Firm* — Birch, Stewart, Kolasch & Birch, LLP

(57) ABSTRACT

Provided is a massage machine enabling an effective massage treatment by a pair of left and right massage members even for users having various sizes or thicknesses of treatment regions. A massage machine according to the present invention includes: a pair of left and right massage members provided so as to hold a treatment region; a rotating shaft provided so as to laterally penetrate the left and right massage members; a drive unit for rotationally driving the rotating shaft; and a conversion part for converting a rotating force of the rotating shaft to a massage operation by the massage members, and in this massage machine, there is provided a horizontal movement mechanism for causing at least one of the pair of left and right massage members to move in a horizontal direction along the rotating shaft by rotating the rotating shaft to thereby make an interval between the pair of left and right massage members variable.

6 Claims, 8 Drawing Sheets

(52) U.S. Cl.
CPC ..... *A61H 2201/164* (2013.01); *A61H 2201/1671* (2013.01); *A61H 2201/1695* (2013.01); *A61H 2205/106* (2013.01); *A61H 2205/12* (2013.01)

(58) Field of Classification Search
CPC ..... A61H 2203/0431; A61H 2205/04; A61H 2205/06; A61H 2205/062; A61H 2205/081; A61H 2205/106; A61H 2205/10; A61H 23/0254; A61H 7/00; A61H 7/001; A61H 15/0078; A61H 15/0028
USPC ..... 601/112
See application file for complete search history.

(56) References Cited

U.S. PATENT DOCUMENTS 7,559,906 B2 * 7/2009 Bugo ..... A61H 7/00 601/133
2002/0161316 A1 * 10/2002 Shimizu ..... A61H 7/00 601/98
2004/0236257 A1 * 11/2004 Hsieh ..... A61H 15/0078 601/127
2006/0030800 A1 2/2006 Kassel et al.
2006/0149173 A1 * 7/2006 Hsieh ..... A61H 15/0078 601/90
2007/0021694 A1 * 1/2007 Shiraishi ..... A61H 7/001 601/94
2008/0091129 A1 * 4/2008 Chen ..... A61H 15/0078 601/98
2011/0004131 A1 * 1/2011 Han ..... A61H 1/0296 601/112

FOREIGN PATENT DOCUMENTS

JP 57-52453 A 3/1982
JP 11-4860 A 1/1999
JP 2002-153532 A 5/2002
JP 2002-248142 A 9/2002
JP 3377195 B2 9/2002
JP 2006-304864 A 11/2006
WO WO 2005/084604 A1 9/2005

* cited by examiner

MASSAGE MACHINE

TECHNICAL FIELD

The present invention relates to a massage machine performing a massage for a treatment region (for example, lower limbs) of a user, in particular, relates to a massage machine capable of providing a comfortable massage even in the case where widths (sizes, thicknesses) of treatment regions are different due to difference in physiques of users.

BACKGROUND ART

For example, as a massage machine including a pair of left and right massage members provided so as to hold a treatment region such as a lower limb (foot or calf), there is an example disclosed in Patent Literature 1. The pair of left and right massage members are driven so as to become close to and separate from each other, and repeat pressing a treatment region oppositely from both left and right sides and loosening this pressing, thereby performing a kneading massage operation.

A drive mechanism provided in this massage machine includes: a rotating shaft provided in a direction penetrating between a pair of left and right massage members; a drive unit for rotationally driving this rotating shaft; a pair of left and right conversion parts for converting a rotating force of the rotating shaft to closing and separating operations of the pair of left and right massage members; and an eccentric rotor provided integrally and rotatably with the rotating shaft for transmitting the rotating force of the rotating shaft to a pressing member.

CITATION LIST

Patent Literature

Patent Literature 1: Japanese Patent No. 3377195

SUMMARY OF INVENTION

Technical Problem

A drive mechanism provided in a conventional massage machine is configured to allow a pair of left and right massage members to perform a massage operation using a rotation of a rotating shaft as a drive source via a pair of left and right conversion parts and, for example, in the case of paying attention to a pair of massage members for holding a left-side lower limb of a user, a left and right width of this paired massage members (an interval between the right massage member and the left massage member) was constant. That is, the massage members are swung at the time of driving and the interval therebetween becomes variable but a variable width thereof was constant.

Therefore, for example, in the case where the left and right width of the pair of massage members for holding, for example, a left-side lower limb is made narrower one while intending to apply an appropriate massage to a thin calf, there may be treated a strong massage for a user having a thick calf to feel pain in some cases. Contrary to this, in the case where the left and right width of the pair of massage members is made wider one while intending to apply an appropriate massage to a thick calf, the massage members will not be touched with appropriate strength for a user having a thin calf and a sufficient massage effect cannot be obtained. This situation is also the same as a pair of massage members for holding a right-side lower limb.

Therefore, the present invention has been made in consideration of the above situation, having an object to provide a massage machine enabling an effective massage treatment by a pair of left and right massage members even for users having various sizes or thicknesses of treatment regions.

Solution to Problem

In order to accomplish the object mentioned above, the following technical measures have been taken in the present invention.

That is, a massage machine according to the present invention includes: a pair of left and right massage members provided so as to hold a treatment region; a rotating shaft provided so as to laterally penetrate the left and right massage members; a drive unit for rotationally driving the rotating shaft; and a conversion part for converting a rotating force of the rotating shaft to a massage operation caused by the massage members, and in this massage machine, a horizontal movement mechanism is provided for causing at least one of the pair of left and right massage members to move in a horizontal direction along the rotating shaft by rotating the rotating shaft to thereby make an interval between the pair of left and right massage members variable.

Preferably, the conversion part includes: a fixed and rotational boss part fixed so as to integrally rotate with respect to the rotating shaft and having an endless cam surface, tilted with respect to the rotating shaft, formed on a circumference; an annular fitting part formed at a proximal end of each of the massage members and slidably fitted to the circumference of the rotating boss part; and a regulating part for regulating the annular fitting part from co-rotating with respect to the rotating boss part.

Preferably, the conversion part includes: a movable and rotational boss part that is movable along a direction of the shaft center of the rotating shaft in a predetermined range on the rotating shaft and having an endless cam surface, tilted with respect to the rotating shaft, formed on a circumference; an annular fitting part formed at a proximal end of each of the massage members and slidably fitted to the circumference of the rotating boss part; and a regulating part for regulating the annular fitting part from co-rotating with respect to the rotating boss part.

Preferably, the horizontal movement mechanism includes: a screw thread part formed on the rotating shaft; and the movable and rotational boss part having a helical internal tooth screwed on the screw thread part formed on an inner circumferential surface in a middle part.

Preferably, the movable and rotational boss part is configured so as to integrally rotate with the rotating shaft upon reaching one end or the other end of the screw thread part.

Preferably, the screw thread part of the horizontal movement mechanism is formed on each of the both end sides in the left and right direction of the rotating shaft, and the screw thread part on one side and the screw thread part on the other side are made in an inverse screw relationship.

Preferably, a pressing member is placed between the pair of left and right massage members, and the pressing member is configured to cover the rotating shaft and the pressing member is configured so as to expand and contract in the horizontal direction with movement of the movable and rotational boss part.

Advantageous Effects of Invention

According to the massage machine of the present invention, it becomes possible even for users having various sizes or thicknesses of treatment regions to perform an effective massage treatment by a pair of left and right massage members.

DESCRIPTION OF EMBODIMENTS

Figure 1:
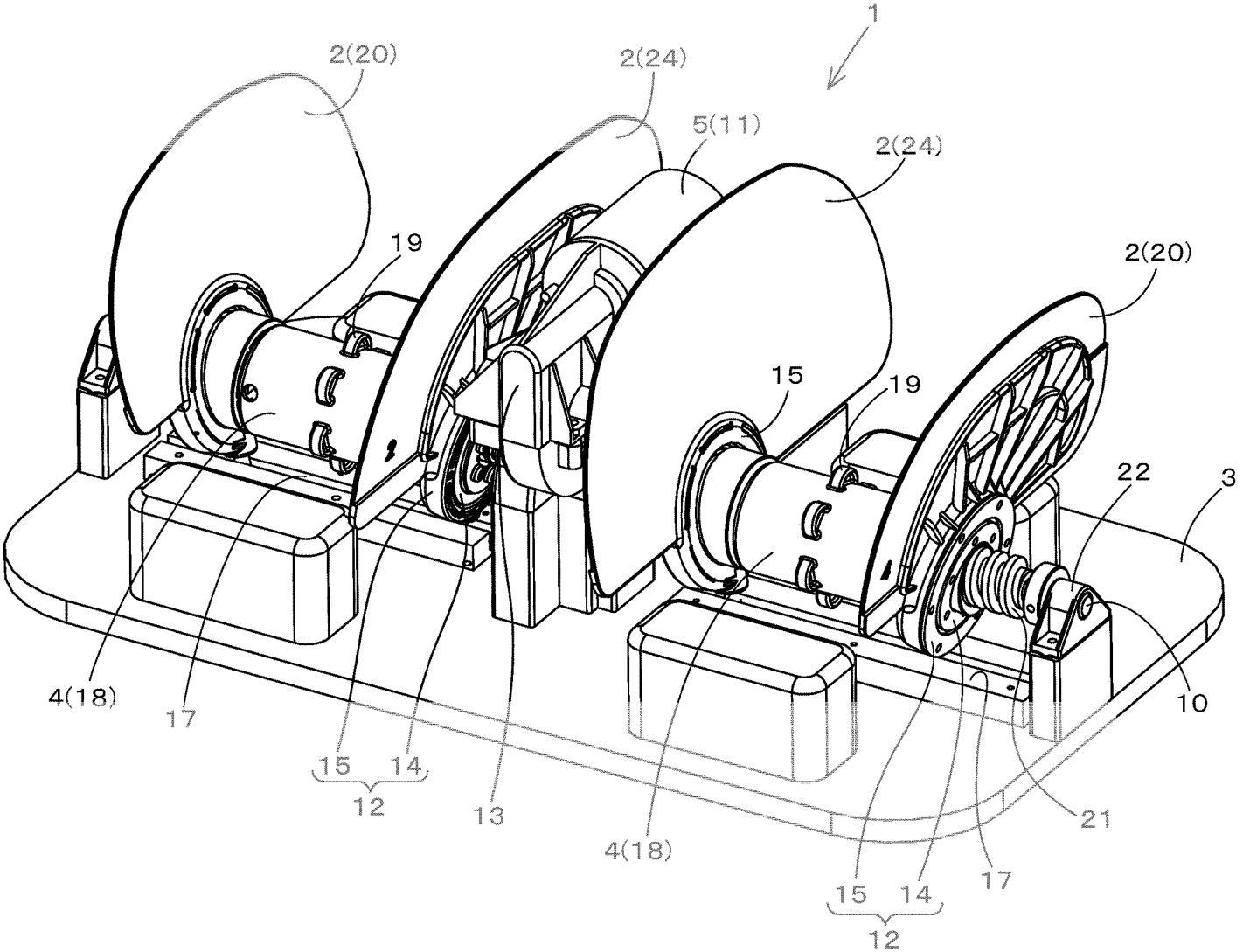
FIG. 1 is a perspective view showing an inner structure of a massage machine of the present invention.

FIGS. 1 to 8 show an embodiment of a massage machine pertaining to the present invention.

The massage machine of the present embodiment is a lower limb massage machine 1 (also, referred to as merely "massage machine 1") for treating lower limbs L as treatment regions, and this massage machine 1 is targeting both of left and right lower limbs L of a user as a massage object and it is configured to be able to apply a kneading massage to both of calves and foot regions composing the lower limbs L.

This massage machine 1 includes massage members 2 for performing a kneading massage and it is provided with a drive unit 5 for driving the massage members 2.

Note that, in the present specification, a "calf" refers to a region under a knee and above a malleolus in a lower limb L of a person, and a "foot region" refers to a region below a malleolus. Further, in FIG. 1, a front and rear direction, a left and right direction (width direction) and an upper and lower direction of the massage machine 1 are depicted for use in the explanation, and these directions correspond to left and right, front and rear, and upper and lower directions when viewed from a user.

The massage machine 1 of the present embodiment includes a generally rectangular plate-shaped base 3 which is disposable on such as a floor surface and further includes: a pair of left and right massage members 2 arranged in parallel separately in the left and right direction in a degree of fitting a foot region or a calf on the upper surface of the base 3; a pressing member 4 (foot sole massage body) provided mutually between the pair of left and right massage members 2; and the drive unit 5 allowing the pair of left and right massage members 2 to become close to and separate from each other.

The pair of left and right massage members 2 is provided in each of the right side and left side on the base 3 so as to correspond to each of a right lower limb L and a left lower limb L of a user.

The massage members 2 are formed in a standing plate shape with a raw material having elasticity in the width direction, and cushion members, cover members or the like may be provided on the mutually opposing inner surfaces of the massage members 2 for softening contact senses to the foot region.

The drive unit 5 is intended to reciprocally operate the pair of left and right massage members 2 between a holding position and a releasing position for a foot region to be fitted in mutually between the pair of massage members to thereby apply a massage operation by kneading to the foot region. This drive unit 5 is adapted to drive the pair of left and right massage members 2 corresponding to the right lower limb L at the same time of driving the pair of left and right massage members 2 corresponding to the left lower limb L.

First, the drive unit 5 includes: one rotating shaft 10 provided in a direction penetrating between the massage members 2 (left and right direction); a drive motor 11 for rotationally driving this rotating shaft 10; and a pair of conversion parts 12 each for converting a rotating force of the rotating shaft 10 to a massage operation of the massage members 2.

The drive motor 11 is switchable between a forward rotating drive and a reverse rotating drive and it is adapted to transmit rotational drive power to the rotating shaft 10 via a decelerating part 13 including a built-in worm gear and a worm wheel which is engaged with the worm gear.

Each conversion part 12 is provided in a portion where the rotating shaft 10 penetrates the massage members 2 and it includes tilted rotors 14 each of which is fixed to the rotating shaft 10 in a skewered state to be integrally rotated with the rotating shaft 10. Each of the tilted rotors 14 is configured so that an annular fitting part 15 provided at a proximal end of the massage members 2 is fitted on from the outside via a bearing which is fitted and mounted on the outer circumference thereof. A tilted cam surface formed on the outer circumference of each of the tilted rotors 14 is made rotatable with respect to the annular fitting part 15 via the bearing, and thus the massage members 2 are adapted to keep a relative rotatable state with respect to the rotating shaft 10.

Further, the conversion part 12 has a structure so as to engage regulating protrusions 16 protruding downward from the massage members 2 to a horizontal groove body 17 which is long in the left and right direction and placed on the base 3. With this engagement between the regulating protrusions 16 and the horizontal groove body 17 (horizontal long hole), the massage members 2 are prevented from co-rotating (following rotation) with each of the tilted rotors 14. That is, it is intended that, when the rotating shaft 10 is rotated, each of the tilted rotors 14 causes vibrations corresponding to tilting components about the rotating shaft 10 and only the vibration components at this time are transmitted to the massage members 2.

The tilting directions of the tilted rotors 14 with respect to the rotating shaft 10 are set so as to be relatively opposite between the pair of massage members 2. Therefore, when the front side upper edges and rear side upper edges of the massage members 2 are in a state of being separated from each other, in the case where the rotating shaft 10 is rotated, the front side upper edge sides of the massage members 2 gradually become close to and the front side lower edge sides of the massage members 2 are separated at the same time, and subsequently the rear side upper edge sides gradually become close to each other to thereby perform a holding operation.

Further, after this holding operation, the rear side lower edges of the massage members 2 gradually become close to and the rear side upper edges of the massage members 2 are separated at the same time, and subsequently the front side lower edge sides gradually become close to and the front side upper edges of the massage members 2 are separated at the same time to thereby perform a releasing operation. By continuously rotating the rotating shaft 10, the massage members 2 are adapted to be swung in a wave-like state under a situation of being regulated within a predetermined angle range while the massage members 2 alternately repeat the holding operation and the releasing operation.

In the case where the rotating shaft 10 is rotated in the direction reverse to that mentioned above, the massage members 2 are also adapted to perform the holding operation and the releasing operation in an order reverse to that mentioned above.

As shown in FIG. 1 and the like, each pressing member 4 includes a rotary rotor 18 which is integrally rotatable with respect to the rotating shaft 10 provided in the drive unit 5 and projections 19 which are placed in distribution at predetermined intervals mutually in the circumferential direction and axial direction on the outer circumferential surface of this rotary rotor 18.

By integrally rotating this pressing member 4 (i.e., the rotary rotor 18) with the rotating shaft 10, it becomes possible to apply a finger pressure massage to a foot region fitted mutually between the pair of left and right massage members 2. The pressing member 4 may be the rotary rotor 18 which is provided in an eccentric state with respect to the rotating shaft 10 to be integrally rotated with the rotating shaft 10.

By the way, as described in detail in "Problem to be solved by the Invention", in the lower limb massage machine 1 having a configuration mentioned above, for example, in the case where a left and right width of the pair of left and right massage members 2 is made narrow in order to apply an appropriate massage to a thin calf, a strong massage may be treated for a user having a thick calf and a user may feel a pain in some cases.

Therefore, the lower limb massage machine 1 of the present embodiment has a configuration (horizontal movement mechanism, i.e., width adjustment mechanism) shown as following.

Note that, since the pair of left and right massage members 2 corresponding to the right lower limb L have substantially the same configuration and operation as those of the pair of left and right massage members 2 corresponding to the left lower limb L, the following description proceeds exemplifying the massage members 2 for massaging the left lower limb L.

That is, a connecting method between the outer-side massage member 2 of the pair of massage members 2 provided in the left side and the rotating shaft 10 is largely different from that of conventional one. This is also the same as the outer-side massage member 2 of the pair of massage members 2 provided in the right side. These massage members 2 (i.e., the outer-side massage member 2 of the pair of massage members 2 provided in the left side, and the outer-side massage member 2 of the pair of massage members 2 provided in the right side) may be referred to as "moving massage members 20" in some cases, hereinafter.

Figure 5:
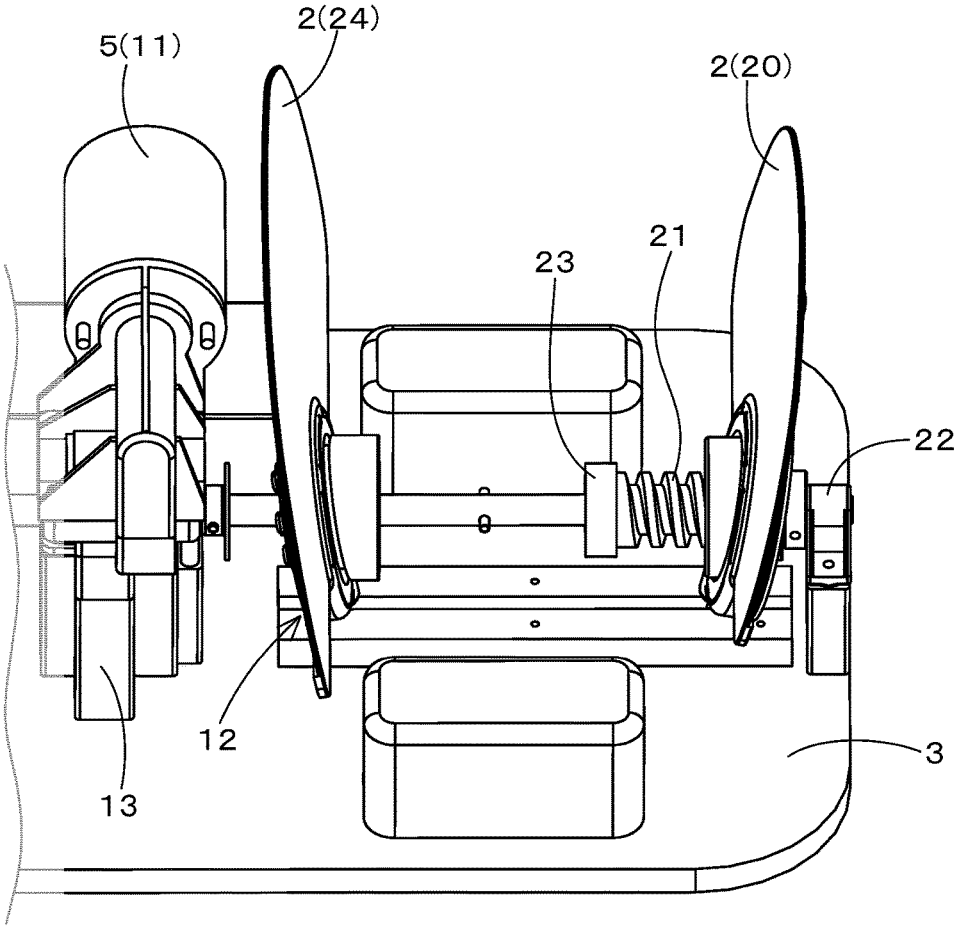
FIG. 5 is a diagram showing that a left and right width of a pair of left and right massage members is in a large width state (omitting a pressing member)
Figure 8:
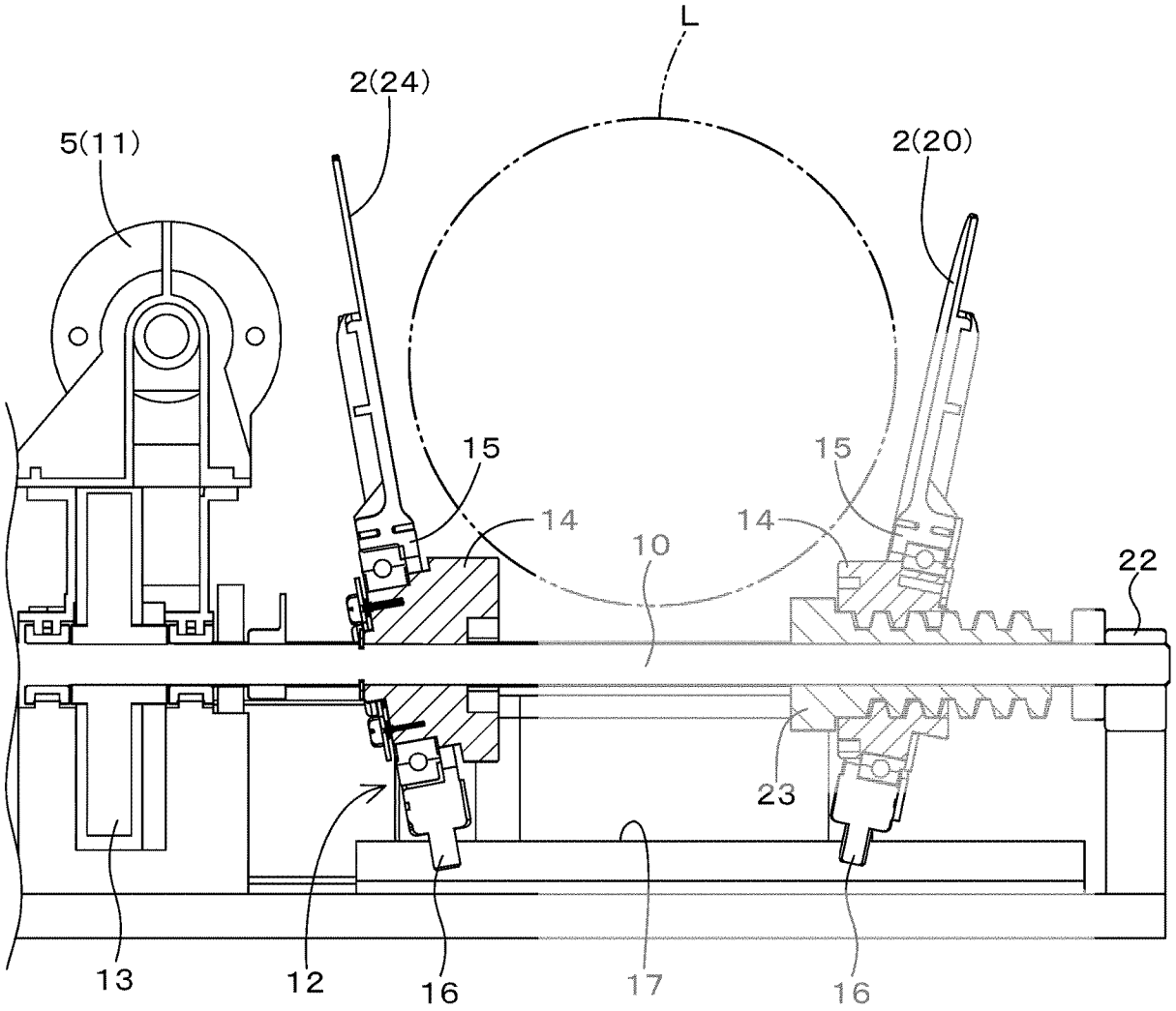
FIG. 8 is a cross-sectional view showing an inner structure of the massage machine of the present invention (omitting a pressing member).

More specifically, as shown in FIGS. 5 and 8, etc., in the lower limb massage machine 1 of the present embodiment, the conversion part 12 for generating a swinging operation to the moving massage member 20 has, first, a screw thread part 21 in a region corresponding to a proximal end of the moving massage member 20, i.e., in a left side portion of the rotating shaft 10.

This screw thread part 21 is formed on the outer circumferential surface of the rotating shaft in the left side portion of the rotating shaft 10. The screw thread part 21 is an external tooth which is formed so as to be wound in a helical state on the outer circumferential surface of the rotating shaft 10 and which is used as a right thread. A size such as a pitch and a shape of the screw thread part 21 are optionally set and not particularly limited, but in the case where the left side screw thread part 21 is a right thread, the right side screw thread part 21 is a left thread.

Meanwhile, the tilted rotor 14 to which the annular fitting part 15 formed at the proximal end of the moving massage member 20 is fitted has a hole in the center thereof through which the rotating shaft 10 is allowed to penetrate, and on the inner circumferential surface of this hole, there is formed a helical internal tooth which is threaded with the screw thread part 21 mentioned above. The tilted rotor 14 swings about the screw thread part 21 and moves in the left and right direction on the screw thread part 21 (rotational drive shaft). In other words, the tilted rotor 14 moves in the left and right direction while rotating on the screw thread part 21.

The tilted rotor 14 at the time of moving to the leftmost side of the screw thread part 21 formed on the rotating shaft 10 is contacted in surface to the side surface portion of a bearing 22 provided on the left side of the base 3 and is adapted to be unmoved any more. In other words, the rotating shaft 10 and the tilted rotor 14 are adapted to be integrally rotated.

Further, the tilted rotor 14 at the time of moving to the rightmost side of the screw thread part 21 formed on the rotating shaft 10 is contacted in surface with a shaft concave part 23 provided at the rightmost end of the screw thread part 21 (this shaft concave part 23 integrally rotates with the rotating shaft 10) and is adapted to be unmoved any more. In other words, the rotating shaft 10 and the tilted rotor 14 are adapted to be integrally rotated.

On the outer circumferential surface (tilted cam part) of the tilted rotor 14 described above, a rotor accommodation concave portion provided at the proximal end of the moving massage member 20 is fitted in via an externally fitted and mounted bearing. With a freely rotating action by this bearing, the moving massage member 20 is adapted to keep a relatively rotatable state with respect to the rotating shaft 10.

Further, the conversion part 12 has a structure of engaging the regulating protrusions 16 protruding downward from the massage members 2 (including not only the moving massage member 20 but also the non-movement massage member 2) with the horizontal groove body 17 (horizontal long hole). By engagement of the regulating protrusions 16 with the horizontal long hole, the massage members 2 are prevented from co-rotating (following rotation) with the tilted rotor 14. That is, it is intended that, when the rotating shaft 10 is rotated, the tilted rotor 14 causes vibrations corresponding to tilting components about the rotating shaft 10 and only the vibration components at this time are transmitted to the massage members 2.

The tilting directions of the tilted rotors 14 with respect to the rotating shaft 10 are set so as to be relatively opposite between the massage members 2. Therefore, when the front side upper edges and rear side upper edges of the massage members 2 are in a state of being separated from each other, in the case where the rotating shaft 10 is rotated, the front side upper edge sides of the massage members 2 gradually become close to and the front side lower edge sides of the massage members 2 are separated at the same time, and subsequently the rear side upper edge sides gradually become close to each other to thereby perform a holding operation.

In addition, in the lower limb massage machine 1 of the present embodiment, the pressing member 4 (foot supporting member) is placed between the pair of left and right massage members 2.

The pressing member 4 is made as a cylindrical member covering the rotating shaft 10, and the projections 19 are provided in the circumferential direction on the outer circumferential surface for massaging a treatment region (for example, a foot sole). This pressing member 4 is formed to have a telescopic structure and it is configured to expanded and contracted in the horizontal direction with movement of a movable and rotational boss part. Therefore, even in the case where the moving massage member 20 is moved in the horizontal direction, the pressing member 4 is also expanded and contracted in the left and right direction and it is intended to prevent the foot region from directly contacting the rotating shaft 10 (rotating member).

[Operation Aspect]

Figure 6:
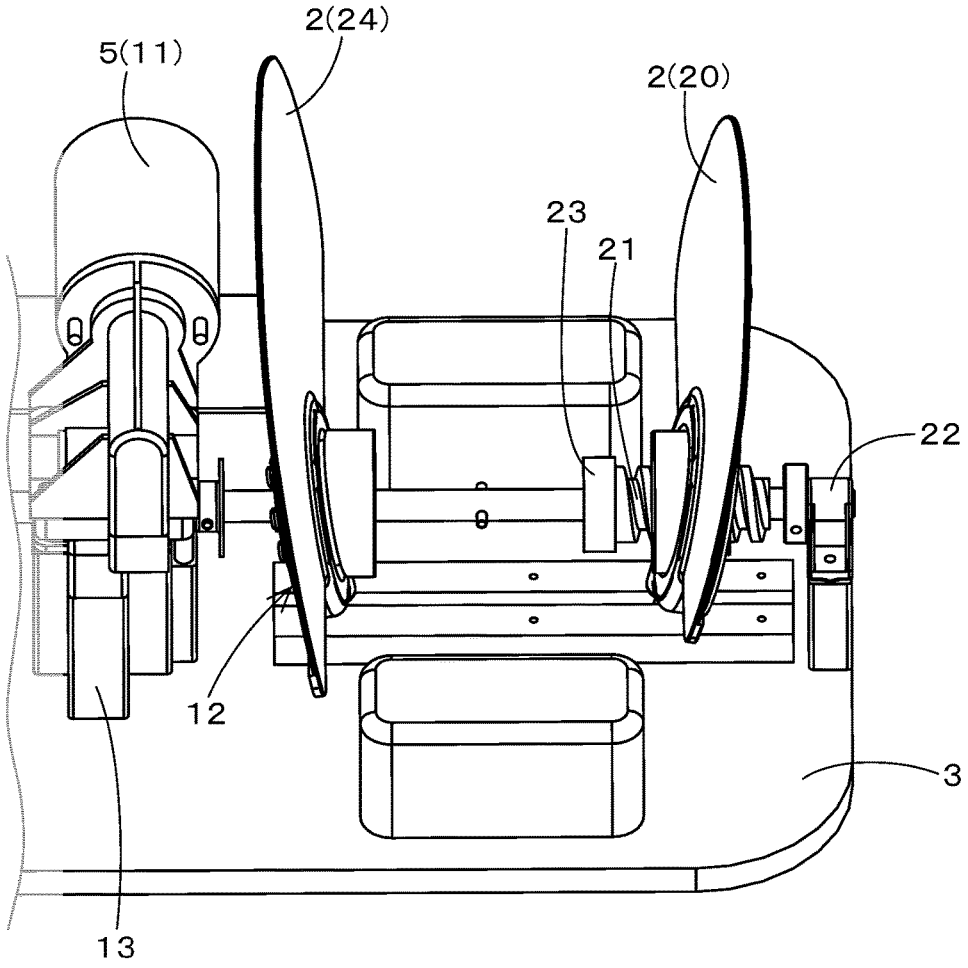
FIG. 6 is a diagram showing that a left and right width of a pair of left and right massage members is in a state of transitioning from a large width to a narrow width or transitioning from a narrow width to a large width (omitting a pressing member)
Figure 7:
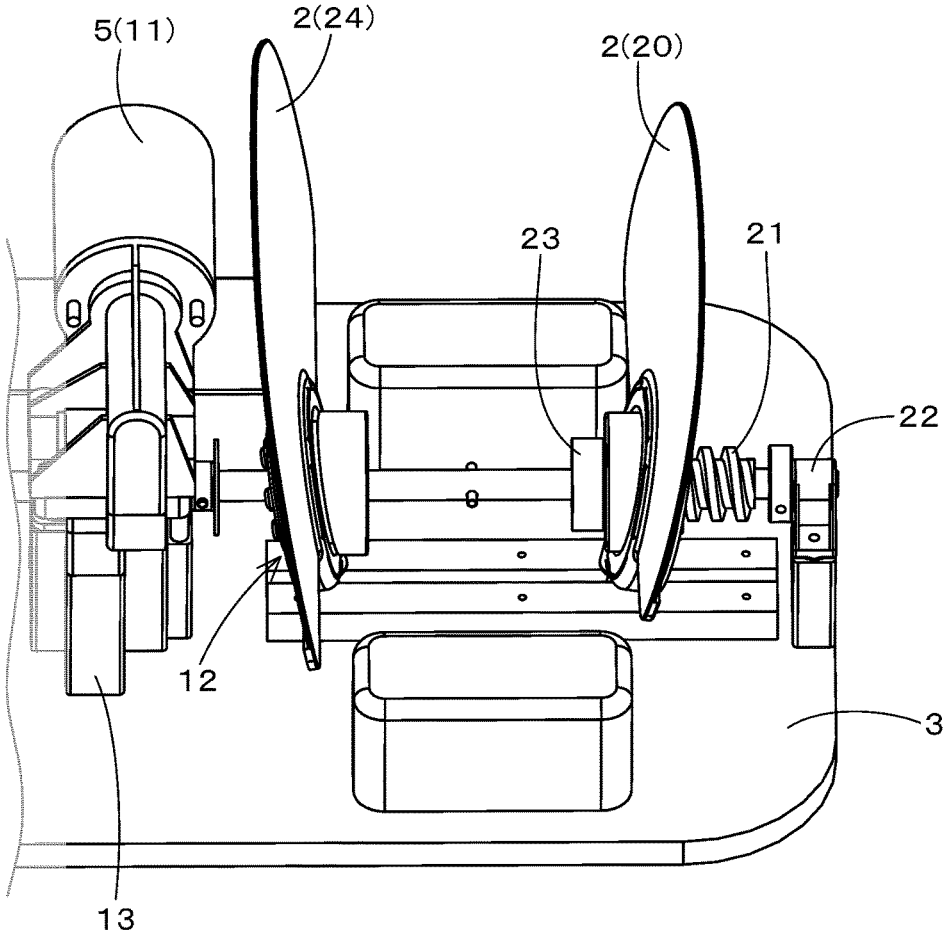
FIG. 7 is a diagram showing that a left and right width of a pair of left and right massage members is in a narrow width state (omitting a pressing member)

Next, an operation aspect of the massage machine 1 of the present embodiment is explained based on FIGS. 2 to 4 and FIGS. 5 to 7. FIGS. 5 to 7 show the structure in the case of omitting the rotary rotor 18 (foot sole massage machine 1) in FIGS. 2 to 4.

Figure 2:
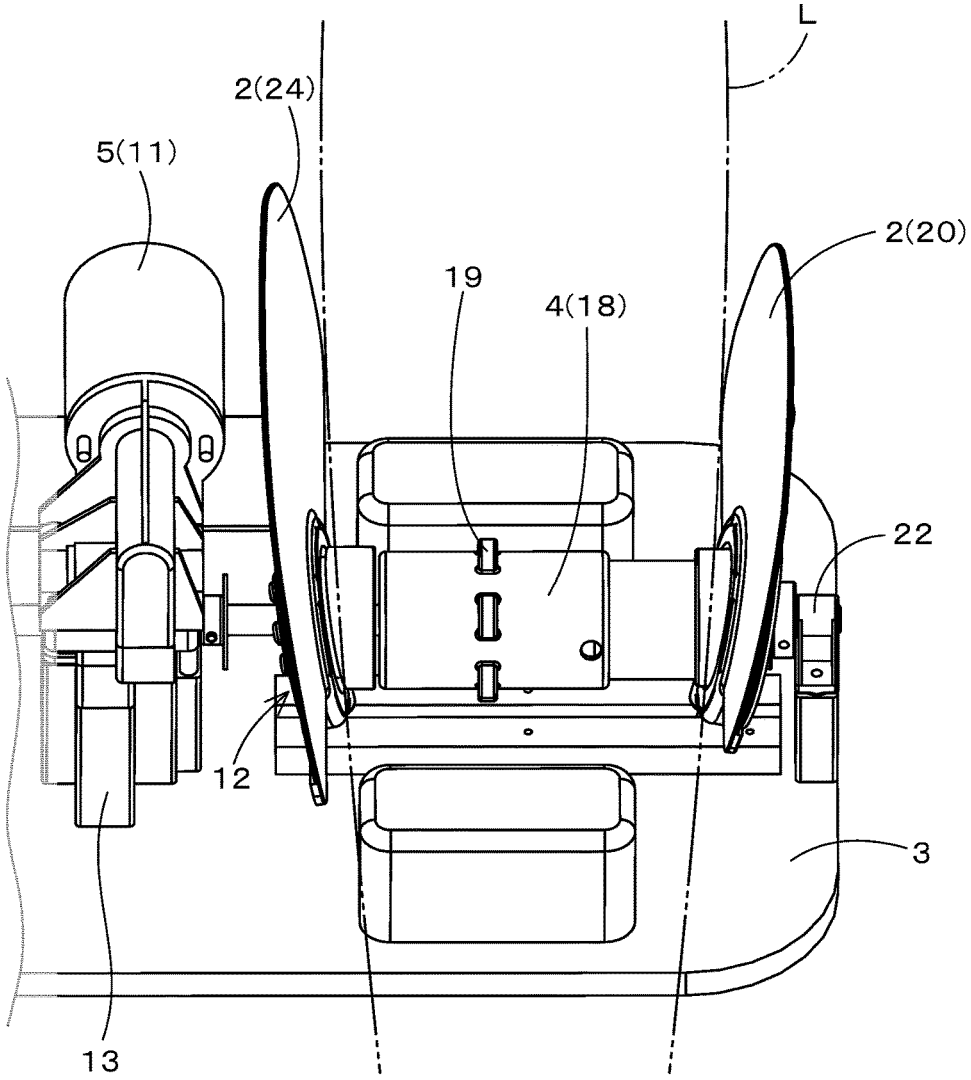
FIG. 2 is a diagram showing that a left and right width of a pair of left and right massage members is in a large width state.

First, as shown in FIGS. 2 and 5, when the rotating shaft 10 is rotated in one direction by the drive motor 11, the tilted rotor 14, which is integrally rotated with the rotating shaft 10, rotates. Also, regarding the massage member 2 (i.e., moving massage member 20) in the side of the pair of massage members 2 provided in the left side, the tilted rotor 14 fitted thereto is contacted in surface to a side surface part of the bearing 22 provided in the left side of the base 3 and it is adapted to be unmoved any more, and the rotating shaft 10 and the tilted rotor 14 are adapted to be integrally rotated. Further, the conversion part 12 has a structure so that the regulating protrusion 16 protruding downward from the massage member 2 is engaged with the horizontal groove body 17 (horizontal long hole).

Therefore, when the rotating shaft 10 is rotated, the tilted rotor 14 cause vibrations corresponding to tilting components about the rotating shaft 10 and only the vibration components at this time are transmitted to the massage members 2. The tilting directions of the tilted rotor 14 with respect to the rotating shaft 10 are set so as to be relatively opposite between the massage members 2. Therefore, when the front side upper edges and rear side upper edges of the massage members 2 are in a state of being separated from each other, in the case where the rotating shaft 10 is rotated, the front side upper edge sides of the massage members 2 gradually become close to and the front side lower edge sides of the massage members 2 are separated at the same time, and subsequently the rear side upper edge sides of the massage members 2 gradually become close to each other to thereby perform a holding operation.

Further, after this holding operation, the rear side lower edges of the massage members 2 gradually become close to and the rear side upper edges of the massage members 2 are separated at the same time, and subsequently the front side lower edge sides of the massage members 2 gradually become close to and the front side upper edges of the massage members 2 are separated at the same time to thereby perform a releasing operation. By continuously rotating the rotating shaft 10, the massage members 2 are adapted to be swung in a wave-like state under a situation of being regulated within a predetermined angle range while the massage members 2 alternately repeat the holding operation and the releasing operation.

Thereafter, in the case where the rotating shaft 10 is rotated in the other direction by the drive motor 11, accompanied with the rotation, the non-movement massage member 24 (the massage member 2 provided in the inner side of the pair of massage members 2 provided in the left side or the massage member 2 provided in the inner side of the pair of massage members 2 provided in the right side) performs a swing operation in a wave-like state in the same manner as described above.

Figure 3:
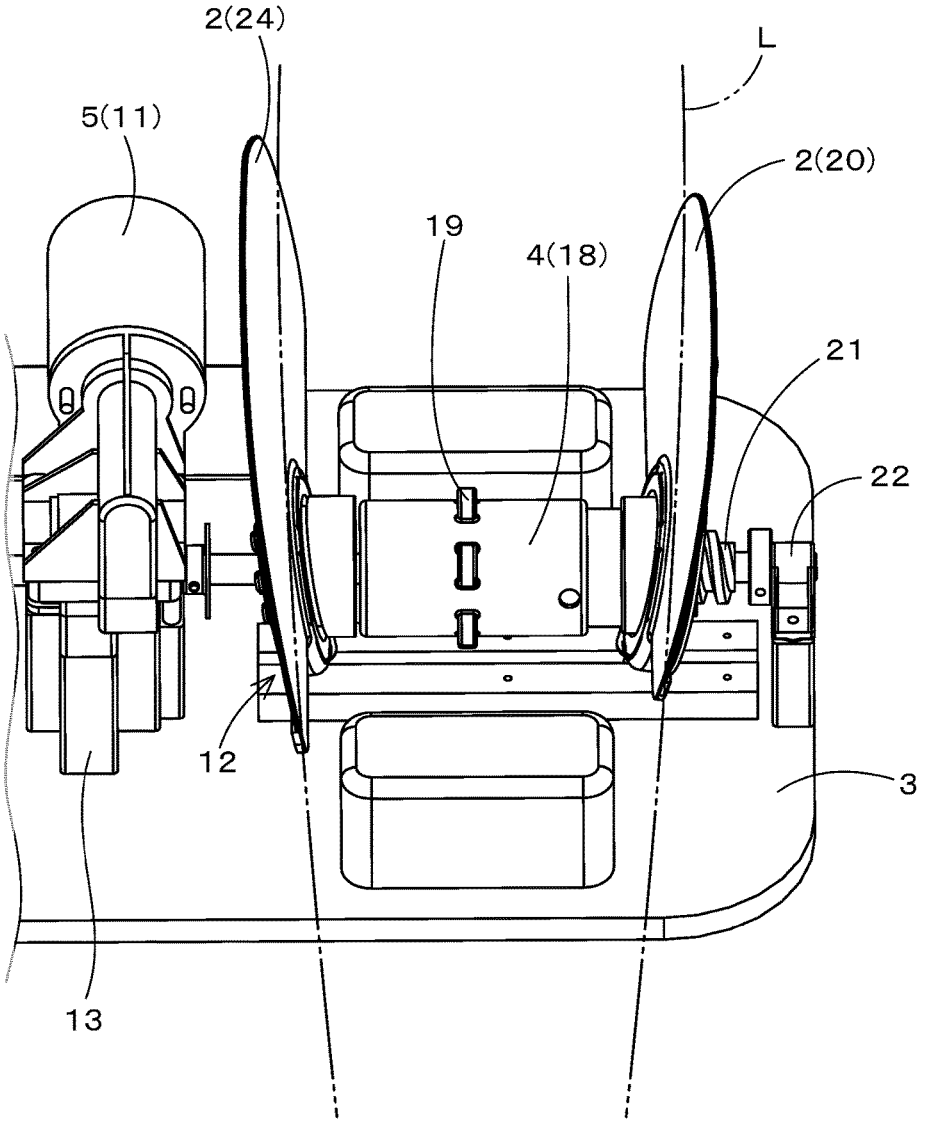
FIG. 3 is a diagram showing that a left and right width of a pair of left and right massage members is in a transition state from a large width to a narrow width or from a narrow width to a large width.

However, as shown in FIGS. 3 and 6, the moving massage member 20 (the massage member 2 provided in the outer side of the pair of massage members 2 provided in the left side, or the massage member 2 provided in the outer side of the pair of massage members 2 provided in the right side) is adapted to move inward of the base 3 along the rotating shaft 10.

That is, the tilted rotor 14 slides about the screw thread part 21 and moves toward the center of the base 3 on the screw thread part 21 (rotating drive shaft). Then, the interval in the width direction of the pair of massage members 2 is narrowed accordingly.

Figure 4:
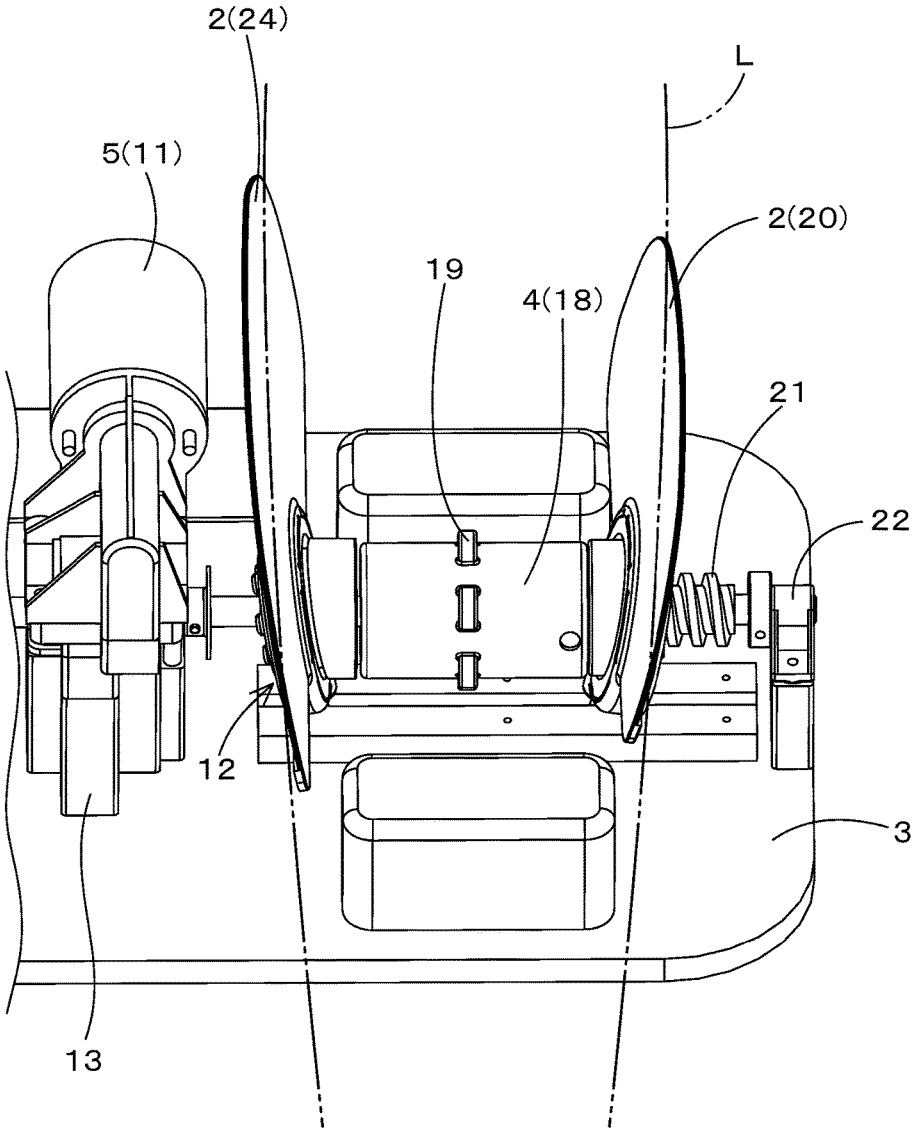
FIG. 4 is a diagram showing that a left and right width of a pair of left and right massage members is in a narrow width state.

Thereafter, as shown in FIGS. 4 and 7, the tilted rotor 14 moves to the rightmost end of the screw thread part 21 is contacted in surface with the shaft concave part 23 provided at the rightmost end of the screw thread part 21 (this shaft concave part 23 integrally rotates with the rotating shaft 10) and is adapted to be unmoved any more. Thereafter, the rotating shaft 10 and the tilted rotor 14 are adapted to be integrally rotated.

Therefore, thereafter, the massage members 2 are adapted to be swung in a wave-like state under a situation of being regulated within a predetermined angle range while the massage members 2 alternately repeat the holding operation and the releasing operation.

As described above, in the lower limb massage machine 1 of the present invention, with provision of a horizontal movement mechanism by which at least one of the pair of left and right massage members 2 moves in the horizontal direction along the rotating shaft 10 by rotating the rotating shaft 10 and the interval between the pair of left and right massage members 2 is made variable, it becomes possible to perform an effective massage treatment by the pair of left and right massage members 2 even for users having various thicknesses of lower limbs L.

Note that, matters not explicitly disclosed in the embodiments disclosed this time, for example, an actuating condition and an operating condition, sizes and weighs of components, and the like are not departing from a range for those skilled in the art to normally carry out but mattes for those skilled in the art to easily anticipate are adopted.

For example, in the embodiment, although a "lower limb" is exemplified as a treatment region, a massage machine (holding and kneading massage machine) for treating an arm (upper limb) or a neck as a treatment region may be used without any problem.

REFERENCE SIGNS LIST

1 . . . Lower limb massage machine
2 . . . Massage member
3 . . . Base
4 . . . Pressing member
5 . . . Drive unit
10 . . . Rotating shaft
11 . . . Drive motor
12 . . . Conversion part
13 . . . Decelerating part
14 . . . Tilted rotor
15 . . . Annular fitting part
16 . . . Regulating protrusion
17 . . . Horizontal groove body
18 . . . Rotary rotor
19 . . . Projection
20 . . . Moving massage member
21 . . . Screw thread part
22 . . . Bearing
23 . . . Shaft convex part
24 . . . Non-movement massage member
L . . . Lower limb

The invention claimed is:

1. A massage machine comprising:

a pair of left and right massage members provided so as to hold a treatment region;

a rotating shaft provided so as to laterally penetrate the left and right massage members;

a drive unit for rotationally driving the rotating shaft; and a conversion part converting a rotating force of the rotating shaft to a massage operation caused by the massage members, a horizontal movement mechanism causing at least one of the pair of left and right massage members to move in a horizontal direction along the rotating shaft by rotating the rotating shaft to thereby make a variable interval between the pair of left and right massage members at two positions on one end side or the other end side of the rotating shaft by rotating the rotating shaft, said horizontal movement mechanism includes a screw thread part rotationally fixed to the rotating shaft, and a movable and rotational first tilt rotor having a helical internal tooth formed on an inner circumferential surface, said helical internal tooth being in operative engagement with the screw thread part, said movable and rotational first tilt rotor configured to integrally rotate with the rotating shaft upon reaching one end or the other end of the screw thread part, and said movable and rotational first tilt rotor is configured so as to reach one end of the screw thread part when the rotating shaft is rotated in one direction by the drive unit and is configured so as to reach the other end of the screw thread part when the rotating shaft is rotated in the other direction.

2. The massage machine according to claim 1, wherein the conversion part comprises:

a second tilt rotor fixed to the other of the pair of left and right massage members and fixed relative to the rotating shaft in the horizontal direction;

an annular fitting part formed at a proximal end of each of the left and right massage members and slidably fitted to a circumference of the respective first and second tilt rotor; and a regulating protrusion operatively connected to the annular fitting part, said regulating protrusion prevents co-rotating of the annular fitting part relative to each of the first and second tilt rotors.

3. The massage machine according to claim 1, wherein the conversion part comprises:

said first tilt rotor is movable along the horizontal direction of the rotating shaft in a predetermined range on the rotating shaft;

a second tilt rotor fixed to the other of the pair of left and right massage members and fixed relative to the rotating shaft in the horizontal direction; an annular fitting part formed at a proximal end of each of the left and right massage members and slidably fitted to a circumference of the respective first and second tilt rotor; and a regulating protrusion operatively connected to the annular fitting part, said regulating protrusion prevents co-rotating of the annular fitting part relative to each of the first and second tilt rotors.

4. The massage machine according to claim 1, wherein the rotating shaft includes a left side and a right side, the screw thread part of the horizontal movement mechanism is formed on the left side of the rotating shaft and a second screw thread part of the horizontal movement mechanism is formed on the right side of the rotating shaft and wherein the screw thread part on the left side and the second screw thread part on the right side are made with an opposite screw relationship.

5. The massage machine according to claim 3, wherein a pressing member is placed between the pair of left and right massage members, wherein the pressing member is configured to cover the rotating shaft and the pressing member expands and contracts in the horizontal direction with movement of the movable and rotational first tilt rotor.

6. The massage machine according to claim 4, wherein a pressing member is placed between the pair of left and right massage members, wherein the pressing member is configured to cover the rotating shaft and the pressing member expands and contracts in the horizontal direction with movement of the movable and rotational first tilt rotor.

* * * * *